United States Patent [19]

Kern et al.

[11] Patent Number: 4,629,833

[45] Date of Patent: Dec. 16, 1986

[54] ELECTRIC HEARING AID

[75] Inventors: Reinhard Kern; Gerhard Krauss, both of Nuremberg; Helmut Schlosser, Röttenbach, all of Fed. Rep. of Germany

[73] Assignee: Siemens Aktiengesellschaft, Berlin and Munich, Fed. Rep. of Germany

[21] Appl. No.: 507,339

[22] Filed: Jun. 24, 1983

[30] Foreign Application Priority Data

Jul. 1, 1982 [DE] Fed. Rep. of Germany ..... 3224614

[51] Int. Cl.[4] ..... H04R 25/00; H04R 1/24; H04R 1/28; H04R 1/38

[52] U.S. Cl. ..... 381/68.2; 381/98

[58] Field of Search ..... 179/107 R, 107 FD, 107 E, 179/107 H, 107 S, 105, 180; 181/130; 381/68, 69, 98

[56] References Cited

U.S. PATENT DOCUMENTS

| | | | |
|---|---|---|---|
| Re. 27,487 | 9/1972 | Hassler | 381/69 |
| 3,772,478 | 11/1973 | McCabe et al. | 381/67 |
| 3,798,390 | 3/1974 | Gage et al. | 179/107 FD |
| 3,909,556 | 9/1975 | Johanson | 179/107 FD |
| 4,109,116 | 8/1978 | Victoreen | 179/107 E |
| 4,456,795 | 6/1984 | Saito | 179/107 FD |

FOREIGN PATENT DOCUMENTS

| | | |
|---|---|---|
| 1739043 | 1/1957 | Fed. Rep. of Germany . |
| 2303194 | 7/1974 | Fed. Rep. of Germany . |
| 2506921 | 8/1975 | Fed. Rep. of Germany . |
| 2490485 | 3/1982 | France . |

OTHER PUBLICATIONS

Book "Hörgerätetechnik" by Werner Güttner, Thieme Verlag, Stuttgart, 1978, pp. 115–118.

*Primary Examiner*—Gene Z. Rubinson
*Assistant Examiner*—Danita R. Byrd
*Attorney, Agent, or Firm*—Hill, Van Santen, Steadman & Simpson

[57] ABSTRACT

An exemplary embodiment comprises an acoustic signal pickup, amplification and reproduction sections wherein the latter contains a plurality of sound sources which influence a shared sound transmission arrangement collecting the sound, influencing it upon formation of a specific transfer characteristic. Given such hearing aids, the originally set frequency characteristic should also be maintained given the maximally attainable output level. To this end, the disclosure provides two identical sound sources, proceeding from which the generated sound is supplied to the ear with specific adaptation to a particular individual hearing loss. For example, the desired transfer characteristic is achieved by establishing selected differential transmission properties for the respective acoustic channels leading from the respective sound sources to the shared passage leading to the ear. An inventively improved hearing aid is particularly suitable for employment as a hearing prothesis for hearing-impaired persons.

23 Claims, 31 Drawing Figures

ELECTRIC HEARING AID

BACKGROUND OF THE INVENTION

The invention relates to an electric hearing aid having a plurality of sound sources for supplying sound to a shared acoustic transmission arrangement Such hearing aids frequently contain devices in order to emphasize individual frequency ranges and in order to lower others. This is done because, for example, hearing aids are required which amplify high frequencies more than low frequencies in order to guarantee matching to a specific hearing impairment. Such so-called high pitch devices have hitherto been achieved, for example, in that they were realized with special microphones (6 dB or, respectively, 12 dB rise per octave in the frequency response) or amplifiers having highpass filter characteristics (cf., for example, the book "Hörgerätetechnik" by W. Güttner, Thieme-Verlag, Stuttgart 1978, pp. 115 through 118).

The two possibilities cited above, however, have the disadvantage that the frequency response of the electroacoustic receiver remains unaltered so that, given full drive of the hearing aid, it is not the acoustical setting but, rather, the efficiency of the receiver which remains the determining factor for the frequency ranges supplied to the hearing impaired person. The loss of hearing in many hearing impaired persons, however, is so great that the hearing aid must be driven to the maximally attainable output level. Since, however, the frequency response at the maximum output level largely corresponds to the efficiency of the receiver, the frequency character of a high pitch device changes in this setting as it approaches the operating limit and becomes broadband so that the high pitch character is lost (cf. FIG. 2).

A hearing aid is known from the papers of the German Utility Model No. 17 39 043 which exhibits two or more differently designed sound sources augmenting one another in terms of their frequency ranges which influence a shared acoustic transmission arrangement which collects the sound. This arrangement, however, only results in an expansion of the frequency range in the sense of as broad as possible an acoustic frequency range transmittable without frequency response adaptation to an individual hearing loss.

SUMMARY OF THE INVENTION

Given a hearing aid of the general type referred to above, the object of the invention is to maintain the frequency character originally set even given the maximally attainable output level. This object is inventively resolved by the adaptation of the phase and relative amplitudes of the outputs from the sound sources, the selection of the respective lengths, cross sections and other acoustic properties of the sound transmission channels, and the like, such that even with identical sound sources, the desired selective adaptation to individual hearing impairment can be achieved. The subclaims contain advantageous further developments and embodiments of the invention.

According to a preferred embodiment, in a hearing aid with acoustic signal pickup, amplification and reproduction, a plurality of sound sources of identical structure are provided which influence a shared arrangement collecting the sound and conducting it to the ear so as to provide a specific selected individual resultant frequency response characteristic, and wherein means for setting the relative influence of the sound sources on the respective sound channels are provided, the frequency ranges are emphasized or, respectively, reduced in the desired manner even given drive of the hearing aid up to the maximally attainable output level because the frequency influencing does not occur until after the amplifier output and a limitation on the influencing of the frequency response characteristic can no longer occur after that.

In one embodiment of the invention, two earpiece receivers standard in hearing aids can be employed as the sound sources, these being driven from the amplifier of the device. The acoustic outputs of these earpiece receivers are then combined with one another in a sound transmission arrangement to the ear. For purposes of adjustment, acoustic means such as nozzles, filters, etc. can be employed in the acoustic paths of the earpiece receivers and also in the sound transmission arrangement leading to the ear. Variable means designed, for instance, as a valve, can also be employed in the lines, their cross-sections being variable therewith. The acoustic effect of the earpiece receivers, however, can also be balanced (or matched) by means of differing operation of the electrical excitation of the two earpiece receivers. Such a balancing can then take place, for instance, by means of differing variation of the volume emitted by the individual earpiece receivers. However, it is also possible to employ a separate output stage for each earpiece receiver.

It is also possible, however, to employ only one earpiece receiver and, given this, to derive sound from both sides of the diaphragm and to treat it in the sense of the combination also provided given employment of two earpiece receivers. As in the case of the arrangement having two earpiece receivers, acoustic influencing elements can be employed in the lines. Such an element, for instance, can also be a three-way valve influencing both the lines from the sound sources as well as the line of the shared sound transmission arrangement.

Further details and advantages of the invention are explained in further detail below with reference to exemplary embodiments illustrated in the Figures on the accompanying drawing sheets; and other objects, features and advantages will be apparent from this detailed disclosure and from the appended claims.

DETAILED DESCRIPTION

Figure 1:
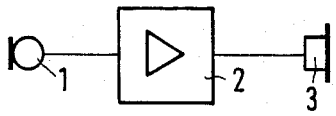
FIG 1 PRIOR ART
FIG. 1 shows the fundamental circuit diagram of a standard hearing aid.
Figure 2:
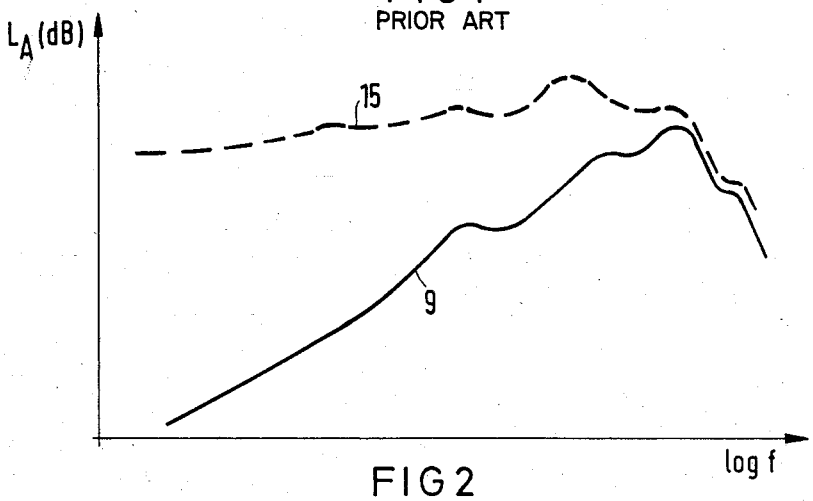
FIG 2 PRIOR ART
FIG. 2 is a diagram of the frequency response attainable with the device according to FIG. 1.

Shown in FIG. 1 in a schematic illustration is a hearing aid having only the simplest parts, a microphone 1, an amplifier 2 and an earpiece receiver 3. The frequency response curves illustrated in FIG. 2 can be achieved with such a device. A frequency response curve for normal operation of amplifier 2 is shown by solid line 9, and a frequency response curve for for the case of maximum output level is shown by dash line 15. In FIG. 2 the logarithm of the frequency is entered along the abscissa and the output level in decibels (dB) is entered along the ordinate. It becomes obvious therefrom that an increasing consideration of higher frequencies indeed ensues after amplification but that low frequencies appear likewise amplified in the output given the maximum output level, as already presented hereinabove under the heading "Background of the Invention".

Figure 3:
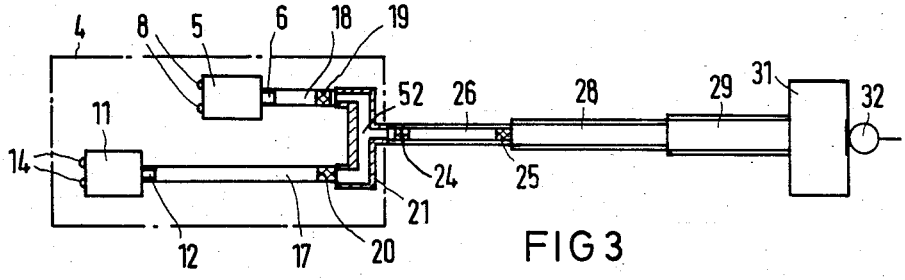
FIG. 3 shows a sound generator having two earpiece receivers.
Figure 4:
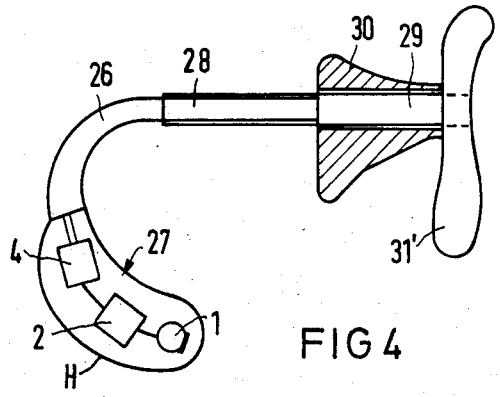
FIG. 4 illustrates a behind-the-ear device with a sound generator according to FIG. 3.

According to an embodiment of the present invention, the earpiece receiver 3 according to FIG. 1 is replaced by a sound generator arrangement 4 according to FIG. 3. The arrangement 4 comprises two earpiece receivers 5 and 11 (of the same type) which are connected to a coupling piece 21 via acoustic lines 17 and 18 of different lengths. A respective acoustic impedance 19, 20 can be inserted in these connecting lines. Similar impedances can also be introduced into the acoustic path and be situated, for instance, as such as are referenced 24 and 25 in FIG. 3 in the line 26 which connects to the output of the coupling piece 21. The actual acoustic path then ensues over an acoustic line 28 and a channel 29 to the ear. In FIG. 3, however, rather than showing an ear coupled with channel 29, a measuring installation is illustrated which comprises a coupler 31 and a microphone 32. In FIG. 4, the arrangement from FIG. 1 and from FIG. 3 are combined and are incorporated in the illustration of a behind-the-ear device 27. This device includes a housing H in which the microphone 1, the amplifier 2 and the sound generator arrangement 4 are situated. The line 26 is situated in the carrying hook of the device 27, the line 28 continuing from said line 26 in the form of a sound transmission tube which delivers sound into an ear adapter 30 which contains the channel 29 representing the actual connection to the ear 31'.

The acoustic impedances 19, 20, 24 and 25 can consist of cross section-reducing inserts such as, for example, porous material, filter-like inserts (e.g. providing a reduced cross section acoustic path) or other constrictions such as nozzles.

Series of measurements can be used to determine which type of acoustic impedances produces the desired effect on a case-by-case basis; the length and diameter of the acoustic channels 17, 18 and 26 can be determined in the same manner.

The two earpiece receivers 5 and 11 can be electrically connected to the output stage of the amplifier 2 in different ways in order to be able to influence the sound reproduction. They can be operated either in series according to FIGS. 5 and 6, or parallel according to FIGS. 7 and 8. Technical criteria such as desired output power, existing impedances of the earpiece receivers, internal resistance of the output stage, etc., cause one or the other version to appear more favorable, e.g. a series connection given high power of the output stage and given low impedance of the earpiece receivers.

Figure 5:
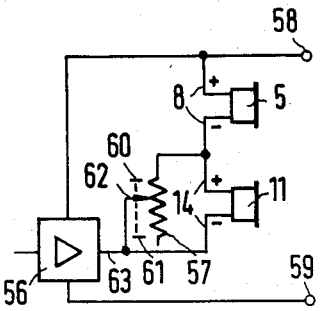
FIGS. 5 and 6 show equiphase and antiphase electrical operation of the earpiece receiver arrangement in a single-ended output stage given series connection of the earpiece receivers according to FIG. 3.
Figure 6:
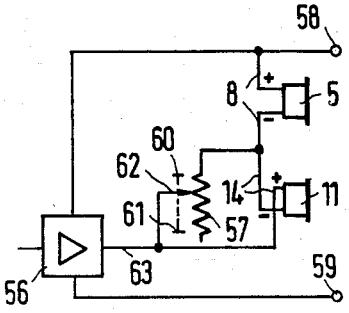

According to FIGS. 5 and 6, the output stage 56 of the amplifier 2 (FIG. 1) is connected via its terminals 58 and 59 to the voltage supply of the hearing aid. Proceeding from the output terminal 63 of the output stage, the output stage current (dc and ac) successively flows through both earpiece receivers 5 and 11. In FIG. 5, the two earpiece receivers are connected such that the acoustic signals at the sound discharge nozzles or couplers 6 and 12 (FIG. 3) respectively appear in phase and, according to FIG. 6, antiphase (out of phase).

The earpiece receiver 11 is respectively bridgeable with a variable resistor 57. In position 61 of the tap 62, the current path is interrupted in the variable resistor 57. The entire output stage current thus flows through the earpiece receiver 11. In position 60, the earpiece receiver 11 is short-circuited and no signal thereby appears at the nozzle or acoustic coupler 12. Given position 61 of tap 62 in FIG. 5 and the structure according to FIG. 3, the circuit according to FIG. 5 produces a frequency curve in FIG. 14 according to curve 68; curve 67 in FIG. 14 corresponds to position 60 of tap 62. For position 61 of tap 62 in FIG. 6, and a structure according to FIG. 3, the circuit of FIG. 6 gives a frequency response curve in FIG. 15 according to curve 69; while position 60 of tap 62 in FIG. 6 corresponds with curve 67 in FIG. 15.

Figure 7:
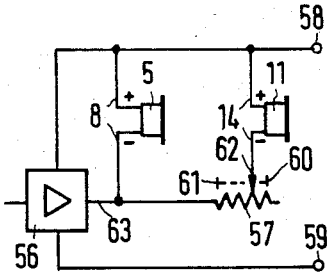
FIGS. 7 and 8 show equiphase and antiphase electrical operation of an earpiece receiver arrangement according to FIG. 3, wherein a parallel connection of the earpiece receivers exists with a single-ended output stage.
Figure 8:
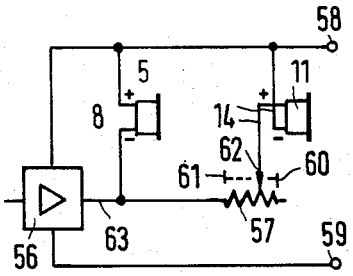

In FIGS. 7 and 8, the earpiece receivers are connected in parallel. They are disposed equiphase (in phase) according to FIG. 7 and antiphase (out of phase) according to FIG. 8. Here, too, the current in the earpiece receiver 11 can be influenced to a lesser or greater degree by the variable resistor 57. In position 61 of the tap 62, full current through the earpiece receiver 11 results; on the other hand a disconnection of the earpiece receiver 11 practically results with tap 62 at the stop 60 due to an isolating i.e. essentially infinite resistance.

Figure 9:
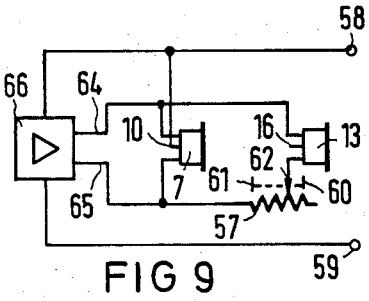
FIGS. 9 and 10 illustrate an equiphase and antiphase electrical operation of an earpiece receiver arrangement according to FIG. 3, wherein a push-pull output stage drives a parallel connection of two earpiece receivers.
Figure 10:
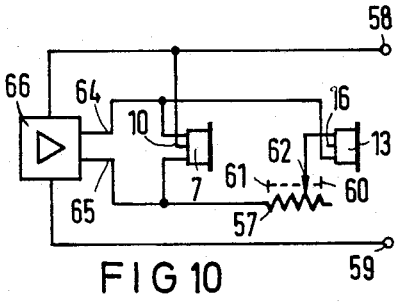

A structure is indicated in FIGS. 9 and 10 wherein a push-pull circuit is employed for exciting the sound generators. Due to the necessity of having sub-signals combined absolutely symmetrically, the earpiece receivers in this case can only be operated in parallel circuitry. Here, too, an amplifier 66 is connected to the terminals 58 and 59 which receive the operating voltage. The supply of direct current to the output stage of amplifier 66 is effected via the center terminal 10 of the push-pull earpiece receiver 7. The terminal 16 of the earpiece receiver 13 is not wired in FIGS. 9 and 10. Since the third terminal is not employed, an earpiece receiver having only two terminals can also be employed. The level in the earpiece receiver 13 can be infinitely variably regulated by means of the regulating unit 57. Equiphase (FIG. 9) and antiphase (FIG. 10) operation is possible even given employment of the push-pull circuit.

Figure 11:
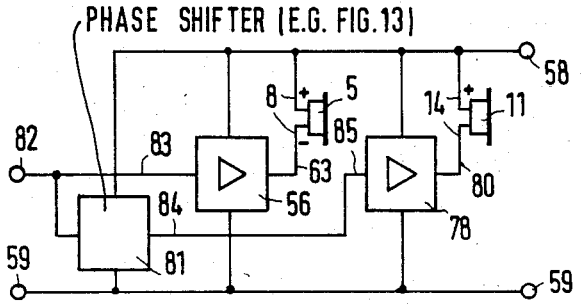
FIG. 11 depicts the employment of two single-ended output stages and two single-ended earpiece receivers as well as of a phase shifter for selective equiphase and antiphase operation of an earpiece receiver arrangement according to FIG. 3.
Figure 12:
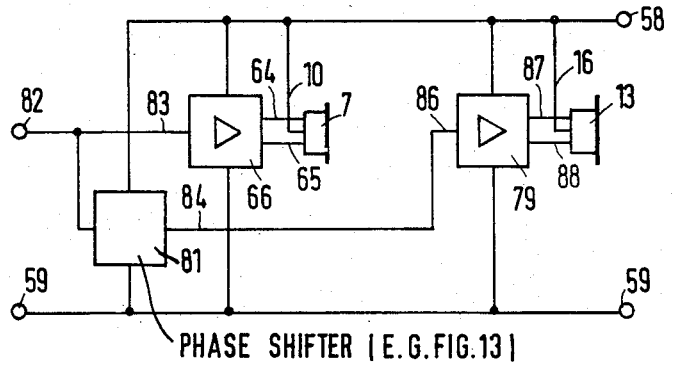
FIG. 12 shows the employment of two push-pull output stages and two push-pull earpiece receivers as well as of a phase shifter for selective equiphase and antiphase influencing of an earpiece receiver arrangement according to FIG. 3.

FIGS. 11 and 12 show two circuit modifications wherein respectively each of the two earpiece receivers, corresponding to the earpiece receiver arrangement according to FIG. 3, is operated by a respectively separate output stage. A circuit arrangement, referred to as phase shifter 81, is required for generating the two signals which are to be forwarded to the two output stages.

Figure 13:
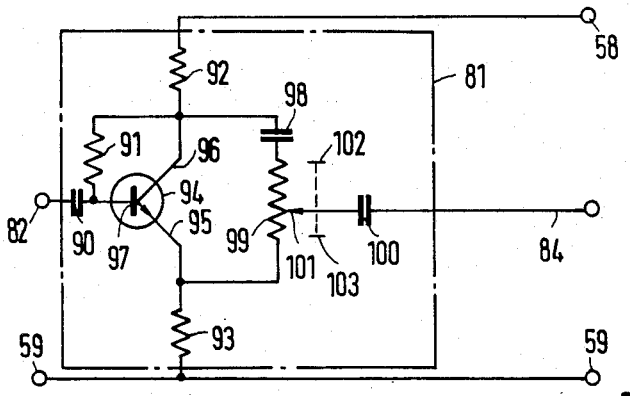
FIG. 13 illustrates a phase shifter employable in the exemplary embodiments of FIGS. 11 and 12.

A phase shift circuit known per se and illustrated in FIG. 13 is employable as the phase shifter 81. The input voltage is connected between an input 82 of the phase shift circuit 81 and a grounded line 59. The signal proceeds over a decoupling capacitor 90, FIG. 13, to the base 97 of a transistor 94. The changing alternating voltage at 97 generates an alternating current through the collector-emitter path of the transistor 94. This current also traverses a collector resistor 92 and an emitter resistor 93 of said stage. When the resistance values of 92 and 93 are selected of equal size, then the alternating voltage across each resistor 92, 93 is also of equal size, the phase of these two voltages is mutually shifted by 180°. (Capacitors 98 and 100 only separate the various dc voltage potentials.) For position 102 of the tap 101 only the voltage of the collector 96 of the transistor 94 (this voltage is phase-shifted by 180° relative to the voltage at point 82), and for position 103 of the tap 101 only the voltage of the emitter 95 (in phase with the input voltage at 82) is coupled with output 84. For intermediate positions of the tap 101 various combinations of the voltages of collector 96 and emitter 95 can be forwarded to the output 84 of the phase shifter stage 81 with the voltage contributions being weighted according to the setting of variable resistor 99. No alternating voltage is supplied to output 84 when tap 101 is at the center of the resistance element of variable resistor 99.

FIG. 11 shows an embodiment of the interconnection of an earpiece receiver arrangement according to FIG. 3 with two single-ended output stages 56 and 78 which each supply respectively one single-ended earpiece receiver 5 and 11 with signals. Each of the output stages 56 and 78 is connected to the operating voltage supply terminals 58 and 59, as are the plus terminals 8+ and 14+ of the single-ended earpiece receivers 5 and 11. The input voltage at 90, FIG. 13, is also supplied to the input 83 of the final emplifier 56. The earpiece receiver 5 is connected with its terminal 8− to the output 63 of the output stage 56. The output stage 78 receives the signal from the phase shift circuit 81 at point 85; the output 80 is connected to the terminal 14− of the earpiece receiver 11.

Two push-pull earpiece receivers 7 and 13 can likewise be interconnected with earpiece receiver arrangement according to FIG. 3 over two push-pull output stages 66 and 79 (FIG. 12); here, too, the two final amplifiers 66 and 79 are connected with the supply voltage terminals 58 and 59 as are the center terminals 10 and 16 of the push-pull earpiece receivers 7 and 13. The earpiece receiver 7 is driven by a signal which is amplified in the output stage 66 without influencing, whereas the earpiece receiver 13 is driven via the output stage 79. This signal is varied in terms of amount and phase by the phase shift circuit 81.

Figure 14:
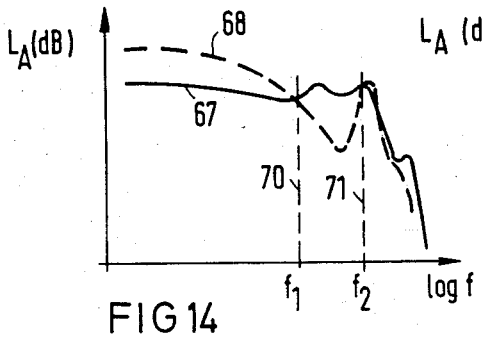
FIG. 14 is a diagram showing the frequency responses which are attainable given equiphase operation of the earpiece receiver arrangement.
Figure 15:
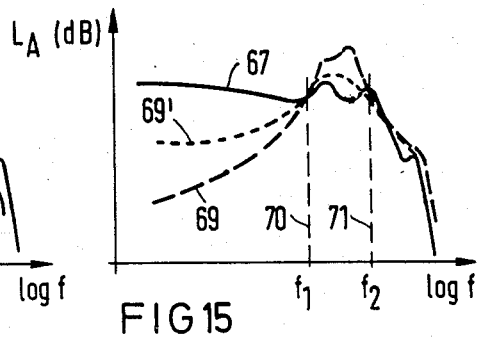
FIG. 15 is a diagram showing antiphase operation of the earpiece arrangement.

The circuits according to FIGS. 11 and 12 function as follows:

In the center position of the tap 101 on the resistor element 99 of the phase shift circuit 81 of FIG. 13, no signal is supplied to output 84. The second output stage circuit 78 or, respectively, 79, receives no signal; thus neither do the earpiece receivers 11 or, respectively, 13; the frequency response 67 of FIGS. 14 and 15 is obtained. When the tap 101 is at the end 102, then the signal at 84 is antiphase relative to the signal at 83; the earpiece receivers 11 or 13 conduct antiphase signals in comparison to the earpiece receivers 5 or 7; and a frequency response according to curve 69 in FIG. 15 is obtained. When the wiper contact 101 is at 103, then the signal at output 84 is in phase relative to that of input 83 and a frequency response according to curve 68 in FIG. 14 is obtained.

The advantage of the circuits according to FIGS. 11 and 12—with the mechanical structure of the earpiece receiver arrangement according to FIG. 3—is that both effects, equiphase and antiphase mode, can be realized with one structure; merely by means of changing the position of the tap of the wiper 101 of the variable resistor 99, all earpiece receiver frequency responses from low pitch characteristic (equiphase according to FIG. 14, curve 68) can be realized with infinitely variable transition up to high pitch characteristic (antiphase according to FIG. 15, curve 69).

The effect of the interconnections according to FIGS. 5 through 12 is illustrated in a diagram for in-phase mode in FIG. 14 and for anti-phase mode in FIG. 15. The results were measured in a structure corresponding to that according to FIG. 3. The logarithm of the frequency is entered on the abscissa in the diagrams and the acoustic output level is entered in decibels on the ordinate. The curved line 67 illustrated with a solid line in FIGS. 14 and 15 then shows the frequency response of the arrangement when the earpiece receiver 11 or, respectively, 13, receives no signal in accord with a position of the tap 62 of the variable resistor 57 at the stop 60. The line 68 shown with a dash line in FIG. 14 is obtained when the tap 62 of the resistor 57 lies at the stop 61. In-phase signals derive in the acoustic nozzles or couplers 6 and 12 (FIG. 3) for in-phase polarity of the two earpiece receivers of FIG. 9 (FIGS. 5 and 7 as well)

and a position of the tap 62 at the stop 61. For low frequencies which lie to the left of the vertical dash line 70 (FIG. 14) parallel to the ordinate, the signals are summed up at the addition point 52 (FIG. 3) to double, i.e. increase by 6 dB, because the two signals transmitted via paths 17 and 18, FIG. 3, meet at the addition point 52 having the same phase and the same amplitude. (The acoustic channel lengths 17 and 18 are still small in comparison to the wavelength of the transmitted frequency.) An increasing phase shift of the two signals relative to one another derives at 52 for increasing frequency due to different transit times of the signals in the acoustic channels 17 and 18 of various lengths; thus the increase at point 52 become antiphase between the vertical dash lines 70 and 71 (FIG. 14) representing frequencies of $f_1$ and $f_2$ so that a reduction of the sum signal is obtained in the aforementioned manner. Concerning the frequency components above the frequency $f_2$ in FIG. 14 and corresponding to the line 71, the dash line curve 68 can again lie above the line 67 because approximately in-phase signals again meet at the addition point 52.

Given antiphase polarity of the earpiece receivers 5 and 11 or, respectively, 7 and 13, the acoustic signals appear antiphase at the sound discharge nozzles or couplers 6 and 12 (FIG. 3). If the amplitudes are of identical size and if the phase shift amounts to precisely 180°, then these signals cancel one another totally at the coupling point 52. This condition, however, only occurs for very low frequencies because phase transit times do not yet appear at low frequencies for the acoustic channel lengths 17 and 18 employed in hearing aids. The sum level 69 (FIG. 15) increases quickly for rising frequencies because the phase angle between the acoustic frequency components in the two channels 17 and 18 becomes increasingly smaller; the phase transit time, as known, changes faster in the longer acoustic channel 17 than in the short acoustic channel 18, as proceeds from curve 69 of FIG. 15. Given the frequency referenced $f_1$ in FIG. 15 and corresponding to the vertical dash line 70, the sum curve 69 intersects the curve 67. The sum curve 69, FIG. 15, lies higher than the curve 67 between the frequencies $f_1$ and $f_2$. Here, the two signals meet at point 52, FIG. 3, approximately in-phase (the signal in the longer acoustic channel 17 has rotated its phase 180° further than that in the shorter channel 18). Both signals add up to form a higher overall level, maximally +6 dB. The sum curve 69, FIG. 15, drops again above the frequency $f_2$. The curve 69' entered with a shorter dash line in FIG. 15 shows the course of the frequency response given a position of the tap 62 of the resistor 57 in the center between the two stops 60 and 61.

Given equiphase drive according to FIGS. 5, 7 and 9, thus, the interconnection of two earpiece receivers 5 and 11 or, respectively, 7 and 13, produces an increase of the sensitivity of the transmission at low frequencies and a reduction of the sensitivity at high frequencies which is also referred to as a low pitch characteristic. The opposite is achieved given antiphase mode, i.e., a reduction of the low frequencies and, thus, a high pitch characteristic.

Figure 29:
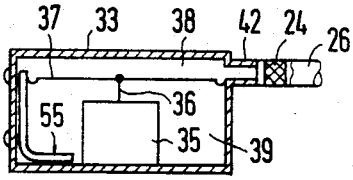
FIG 29 PRIOR ART
FIG. 29 illustrates an earpiece receiver with a tubular connection between the space lying in front of and the space lying behind the diaphragm.

A known earpiece receiver is illustrated in FIG. 29 wherein the space referenced 38 lying in front of and the space referenced 39 lying behind the diaphragm 37 of an earpiece receiver are connected over a tube 55 for setting an internal bass reduction. Reference numeral 35 thereby represents the drive system, and reference numeral 36 represents the drive pin of the earpiece receiver. Together with an air column in the tube 55, the volume 39 forms a Helmholtz resonator having a resonant frequency $f_{res}$ (lines 74 in FIG. 31).

Figure 31:
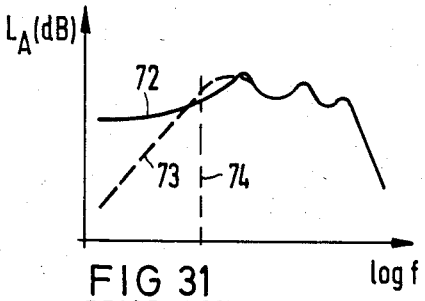
FIG 31 PRIOR ART
FIG. 31 is a diagram of the frequency responses which are attainable given the known earpiece receiver according to FIG. 29.

The frequency response attainable with an earpiece receiver according to FIG. 29 is illustrated in FIG. 31. The line 72 thereby indicates that frequency response attainable given a closed tube 55, and the line 73 represents that frequency response attainable given an open tube 55 in FIG. 29. The remaining test installation corresponds with that according to FIG. 3. The arrangement 4 has merely been replaced by means of the earpiece receiver according to FIG. 29, however, only a permanently set bass reduction is possible, this not being variable.

Figure 26:
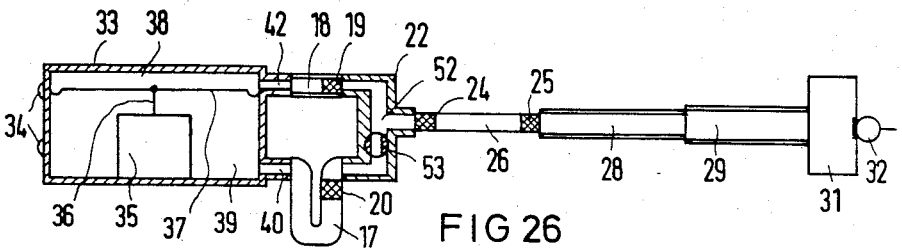
FIG. 26 shows a sound generator with sound pickup disposed at both sides of the diaphragm and employing a valve according to FIGS. 16 through 18.
Figure 27:
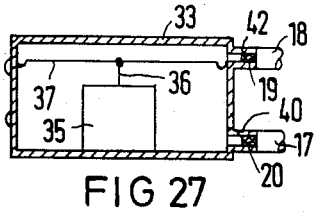
FIG. 27 shows a modification of the sound generator of FIG. 26.
Figure 28:
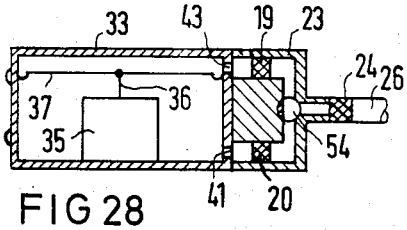
FIG. 28 shows a further modification employing a three-way valve according to FIGS. 19 through 23.

When lines 17 and 18 are laid between the cavities 38 and 39 in the sense of the arrangement 4 from FIG. 3, then one obtains an arrangement which largely corresponds to that according to FIG. 26. Fittings 40 and 42 are thereby merely provided at the sound generator, the lines 17 and 18 being connected to said fittings. Variable setting devices can then be provided in said lines. Some of the possibilities which can thereby be executed are shown in FIGS. 26 through 28. Given the sound generator 33 according to FIG. 26, a second acoustic nozzle 40 is attached such that this is applied in the cavity 39 behind the diaphragm 37. A further nozzle 42 conducts the sound from the front side of the diaphragm 37 out of the cavity 38. It can be seen that that acoustic signals of the two nozzles 40 and 42 are antiphase for all frequencies nearly up to the upper limiting frequency of the earpiece receiver. Both nozzles or couplers 40 and 42 are connected over a respective acoustic channel 17 and 18 to a coupling piece 22 (FIGS. 16–18 and 26) or, respectively, 23 (FIGS. 19–23 and 28). The channels 17 and 18 can be of different lengths, whereby their lengths are to be selected in the sense of the desired frequency response. The channels 17 and 18 can also contain acoustic damping elements 19 and 20 (FIGS. 26–28) which function in the same manner as in FIG. 3, etc. The damping elements 19 and 20 can also be built in at other locations of the acoustic path, for instance, in the acoustic nozzles or couplers 40 and 42 of the sound generators 33 as shown in FIG. 27.

The various coupling pieces which are designed as valve systems 22 and 23 can either be connected to a sound generator having two nozzles or couplers as in FIGS. 26 and 27, being connected over acoustic lines 17 and 18 of different lengths or, in another execution according to FIG. 28, can be glued to a sound generator which only exhibits acoustic passages 41 and 43 (FIG. 28) at the corresponding locations. In this embodiment of FIG. 28, the coupling piece 23 becomes a component of the sound generator itself and receives a space-saving form. To this end, the connecting channels in the coupling piece 23 (FIG. 28) can also be integrated therein and receive a meander-like course.

Figure 16:
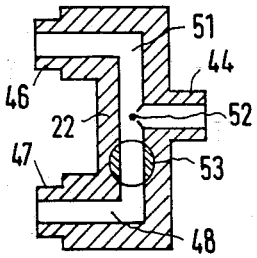
FIGS. 16 through 18 show the employment of a valve as an acoustic switch means.
Figure 17:
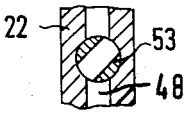
Figure 19:
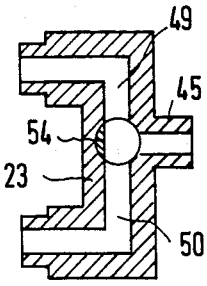
FIGS. 19 through 23 show the employment of a three-way valve.
Figure 30:
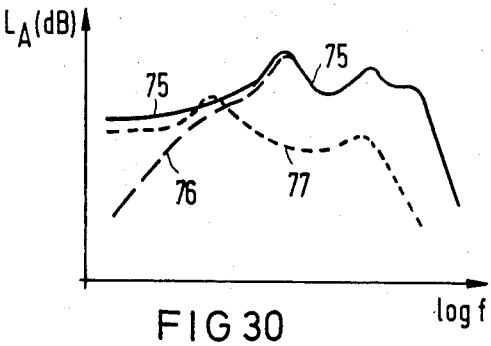
FIG. 30 is a diagram of the frequency responses which are attainable with sound generators according to FIGS. 26 through 28.

Given employment of a coupling piece according to FIG. 16 or 19, a change of the transmission cross-section can be provided in the channel 48 or, respectively, 50. An effect as FIG. 30 is thereby attainable. A valve-like element can be employed in order to change the cross-section, for instance, a valve having a three-way valve plug 54 (FIGS. 19–23) as the regulating element which allows the channel to be closed to a greater or lesser degree.

When the regulating element, i.e., the valve plug 53 or 54, is built in between the back cavity 39 and the addition point 52 e.g. as in FIG. 26 or 28, then transmission curves between the frequency responses corresponding to lines between the curves 75 and 76 of FIG. 30 can be achieved.

Figure 18:
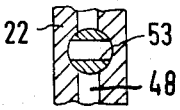

The frequency response corresponding to the sold line 75 of FIG. 30 is obtained corresponding to a position of the valve plug 53 at right angles relative to the line 48 as in FIG. 18. The effect of a sound generator having only one acoustic output, the channel 42 in the present case, is thereby achieved. The position of the valve plug 53 shown in FIG. 16 produces a bass reduction in the frequency response according to the dash line 76 in FIG. 30. When the valve plug is incorporated in the acoustic channel between the space 38 and the addition point 52, then transmission curves between the frequency responses corresponding to the lines 75 and 77 can be set.

Figure 20:
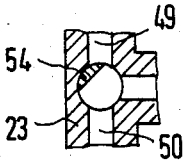
Figure 21:
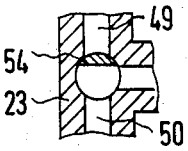
Figure 22:
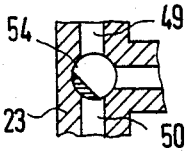
Figure 23:
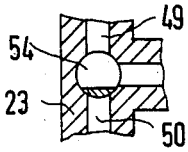
Figure 24:
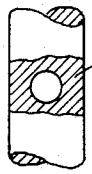
FIG. 24 is a longitudinal cross-section through a valve plug which is employed as a switch element in the two-way valve according to FIGS. 16 through 18.
Figure 25:
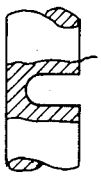
FIG. 25 is a longitudinal cross-section through a valve plug which is employed as a switch element in the three-way valve according to FIGS. 19 through 23.

Given a coupling piece according to FIGS. 19 through 23, the variation of the frequency response from the curve 77 over curve 76 to curve 75 according to FIG. 30 can be achieved with a single valve plug 54 which is rotatable by 180°. Given a position of the valve plug 54 according to FIG. 19, the progression of curve 76 is achieved; given a position according to FIG. 21, the progression of the curve 77 is obtained; and given a position according to FIG. 23, that of the curve 75; in each case the channel 49 is connected to the cavity 38 and the channel 50 is connected to the cavity 39 behind the diaphragm 37. Possible intermediate positions of the valve plug 54 are shown in FIGS. 20 and 22, whereby respectively one channel 49 or 50 remains open at the point 51 and the other is more or less closed. This possibility is achieved by means of a special design of the valve plug 54 as indicated in FIG. 25. Whereas, given the executions according to FIGS. 16 through 18 and 24, the valve plug 53 exhibits the shape and effect of a beer tap given insertion into the channel 48, given the design according to FIGS. 19 through 23 and 25 (with omission of one side wall of the valve plug 53), the working principle of a three-way valve is achieved by means of retaining only a part cross-sectionally representing a single segment of a circle.

It will be apparent that many modifications and variations may be made without departing from the scope of the teachings and concepts of the present invention.

In the measurement arrangements of FIGS. 3 and 26, the results of which are entered in the diagrams of FIGS. 14, 15 and 30 have been obtained with acoustic lines 17 and 18 with a line 17 being 30 mm long and a line 18 being 4 mm long. Both lines 17 and 18 had an inside diameter of 1.2 mm and were fastened on the couplers 6, 12 (FIG. 3) and 40, 42 (FIG. 26) of the receivers 5,11 and 33. The receivers 5 and 11 used in the arrangement of FIG. 3 are receivers ED 1932 which can be bought by the firm Electronics Inc., 3100 North Mannheim road, Franklin Park Ill. 60131, USA. The receiver 33 used in an arrangement of FIG. 26 is a receiver BI 2588 of said Electronics Inc. firm and is supplied with a coupler 40 corresponding to coupler 42. The lines 26 of FIGS. 3 and 26 contained an acoustic impedance 25 which can be bought as acoustic damping plug BF 1861 of said Electronic Inc. firm. Neither in the arrangement of FIG. 3 nor in the arrangement of FIG. 26 is contained any impedance 19, 20 or 24 for the measurement.

SUMMARY OF OPERATION

In one aspect, the present invention relates to a hearing aid with acoustic signal pickup means (e.g. 1, FIG. 1), amplification means (e.g. 2, FIG. 1) and sound reproduction means such that, with only a single sound transmission channel, a frequency response is obtained as represented at 67 in FIGS. 14 and 15, and at 75 in FIG. 30. Such frequency response may be obtained with the measurement arrangement of FIG. 3 where only the sound source 5 is activated, for example with a driving signal with a constant amplitude as a function of frequency over the auditory frequency range of interest for hearing aids. Such frequency response as shown at 67 in FIGS. 14 and 15 and as shown at 75 in FIG. 30 generally corresponds to the frequency response indicated at 15 in FIG. 2 which is obtained when a conventional hearing aid is set to provide maximum amplification. The frequency response at 15 in FIG. 2 may be taken as the maximum response characteristic for the case of full drive of the sound sources such as 5 and 11, FIGS. 3, 5 through 8, and 11, and such as 7 and 13, FIGS. 9, 10 and 12.

In order to retain a high pitch frequency response characteristic even when the sound sources supply a generally flat acoustic output as a function of frequency over the auditory frequency range of interest for hearing aids, a second sound source is coupled via a second sound transmission channel to a shared acoustic transmission arrangement, or common acoustic transmission channel with the two sound transmission channels or the two sound sources having a selectively adjustable parameter for adapting the resultant frequency response to a specific individual hearing loss even when the two sound sources supply identical acoustical amplitude functions as a function of frequency.

EXAMPLE 1

In a first example according to FIG. 3, two identical receivers 5 and 11 each receive substantially the same driving signal from an amplifier set e.g. at maximum gain. The acoustic outputs of the two receivers 5 and 11 each correspond to the response curve 15 in FIG. 2. In order to obtain a high pitch resultant response, the sound sources 5 and 11 are driven so as to provide out of phase acoustic signals at point 52 which substantially cancel at the lowest frequency of interest. The two sound transmission channels are identical except as to length. The length of the longer channel 17 is selectively variable and is selected such that the resultant response as a function of frequency as measured at 32, FIG. 3, corresponds to that shown at 69 in FIG. 15, with frequencies $f_1$ and $f_2$ lying in the range where high frequency boost is most advantageous for a particular hearing impaired individual.

EXAMPLE 2

The lengths of channels 17 and 18 in FIG. 3 are selected as in Example 1, and an arrangement as shown in FIG. 6 is utilized to drive identical receivers 5 and 11. The tap 62, FIG. 6, is set at a central position between stops 60 and 61, so that a resultant response characteristic as shown at 69' in FIG. 15 is obtained which is optimum for a particular hearing impaired individual. (In Ex. 1, the tap 62, FIG. 6, would be set at 61 for equal energization of receivers 5 and 11.)

We claim as our invention:

1. A hearing aid with acoustic signal pickup means, amplification means, and sound reproduction means, said sound reproduction means comprising two sound sources, a common acoustic transmission channel, and sound transmission channels coupling the sound sources with said common acoustic transmission channel, said sound sources each being constructed for supplying acoustic frequency components covering a frequency range of sound to be supplied to the ear of the user, said sound reproduction means providing different sound transmission properties for the respective sound transmission channels such that a selected individually adapted differential transmission of the acoustic frequency components results via the respective sound transmission channels and such that relative amplitudes of the acoustic frequency components result at the common acoustic transmission channel representing a resultant frequency response specifically conformed to the individual hearing impairment of the user in spite of high gain operation of the amplification means, said two sound sources comprising respective earpiece receivers of the same type, said sound transmission channels having respective different lengths such that the phase of sound transmission for selected frequencies along one transmission channel changes by at least 180° compared to the phase of sound transmission for the same selected frequencies along the other transmission channel within the frequency range of acoustic frequency components supplied by said earpiece receivers.

2. A hearing aid according to claim 1 further comprising a valve system for selectively changing the cross-section of at least one of said sound transmission channels to adapt the resultant frequency response of the sound reproduction means to said individual hearing impairment.

3. A hearing aid according to claim 2, wherein the valve system comprises a three-way valve with a rotatable valve plug angularly adjustable to respective different cross-section restricting positions so as to adapt the resultant frequency response of the sound reproduction means to said individual hearing impairment.

4. A hearing aid according to claim 3, wherein the valve plug of the three-way valve has a diameter which at least corresponds to a circle whose center lies at the intersection of the sound transmission channels with said common acoustic transmission channel, and has a shape corresponding to a segment of the circle with a chord of the segment being of sufficient extent to selectively cover the sound transmission channels at said intersection thereof with said common acoustic transmission channel.

5. A hearing aid according to claim 1, wherein said amplification means comprises a single-ended output stage, said earpiece receivers being electrically connected in series to said output stage.

6. A hearing aid according to claim 1, wherein said amplification means comprises a single-ended output stage, said earpiece receivers being electrically connected in parallel to said output stage.

7. A hearing aid according to claim 1, wherein said amplification means comprises a push-pull output stage, said earpiece receivers being electrically connected in parallel to said output stage.

8. A hearing aid according to claim 1, wherein said amplification mean comprises two single-ended output stages each connected to one of said earpiece receivers, and phase shifter means interposed between said acoustic signal pickup means and said output stages for selective in phase and out of phase operation of said earpiece receivers.

9. A hearing aid according to claim 1, wherein said amplification means comprises two push-pull output stage, at least one of said earpiece receivers being a push-pull receiver, said receivers being electrically connected to the respective output stages, and phase shifter means interposed between said acoustic signal pickup means and said output stages for selective in phase and out of phase operation of said earpiece receivers.

10. A hearing aid according to claim 1, with said sound reproduction means having resultant frequency response adapting means for selectively varying the respective acoustic frequency components supplied to said common acoustic transmission channel from the respective sound transmission channels so as to provide a resultant frequency response of the sound reproduction means which is precisely adaptable to a wide range of individual hearing loss characteristics.

11. A hearing aid according to claim 1, with said earpiece receivers supplying acoustic frequency components which are in phase, the different lengths of said sound transmission channels being such that low frequency components transmitted by the respective channels combine additively at the common acoustic transmission channel while higher frequency components within the frequency range are out of phase at said common acoustic transmission channel and tend to cancel each other.

12. A hearing aid according to claim 1, with said sound sources supplying acoustic frequency components which are out of phase, the different lengths of said sound transmission channels being such that the lowest frequency components as transmitted by the respective channels tend to cancel each other at the common acoustic transmission channel while progressively higher frequency components within the frequency range are progressively more nearly in phase so as to be additive at the common acoustic transmission channel.

13. A hearing aid according to claim 1, with said sound reproduction means including phase selection means for selectively progressively varying the phase relationship between the acoustic frequency components supplied by the respective earpiece receivers, and including means whereby the different phase relationships selectable by said phase selection means provide respective different relative amplitudes as a function of frequency of the frequency components at the common acoustic transmission channel.

14. The method of adapting the frequency response of a hearing aid having plural sound sources each supplying acoustic frequency components covering an overall wideband acoustic frequency range when driven at a maximum output level, and having respective sound transmission channels each receiving the acoustic frequency components covering said overall wideband acoustic frequency range from a respective one of said sound sources, with the respective sound transmission channels having respective outputs and having respective acoustic lengths which can be adjusted to change the relative phases of acoustic frequency components as supplied at said outputs, said method comprising:

(a) energizing the sound sources with a common range of acoustic frequencies, and supplying to each of the sound transmission channels corresponding acoustic signals having said common range of acoustic frequencies, (b) selectively modifying the length of one of the sound transmission channels in comparison to another such that the acoustic frequency components after transmission to the outputs of the respective sound transmission channels have relatively adjusted phases at respective frequencies over the overall wideband acoustic frequency range, and (c) combining the acoustic frequency components from the outputs of the sound transmission channels and transmitting a resultant of the combined acoustic frequency components to the ear of a hearing impaired individual, (d) the selectively modifying step being carried out such that the resultant of the combined acoustic frequency components has a substantially lower amplitude in one part of the overall wideband acoustic frequency range relative to other parts of said frequency range than the corresponding acoustic frequency components at the output of either of said sound transmission channels.

15. The method of claim 14, wherein said selectively modifying step selects the length of one of the sound transmission channels relative to another such that the resultant of the combined acoustic frequency components has a substantially lower amplitude in a low frequency range and a substantially higher amplitude in a higher frequency range than the corresponding acoustic frequency components of either of said sound transmission channels.

16. The method of claim 15, wherein the sound sources are identical and receive substantially the same driving signal.

17. The method of adapting the frequency response of a hearing aid having plural sound sources each supplying acoustic frequency components covering an overall wideband acoustic frequency range when driven at a maximum output level, and having respective sound transmission channels each receiving the acoustic frequency components covering said overall wideband acoustic frequency range from a respective one of said sound sources, with the respective sound transmission channels having respective outputs and having respective acoustic lengths such that the relative phases of the acoustic frequency components from the respective sound sources can be adjusted as supplied at said outputs, said method comprising:

(a) supplying driving signals to the sound sources with a common range of acoustic frequencies, and supplying to each of the sound transmission channels corresponding acoustic signals having said common range of acoustic frequencies, (b) selectively modifying the phase of the driving signal supplied to one of the sound sources in comparison to another such that the acoustic frequency components after transmission to the outputs of the respective sound transmission channels have relatively adjusted phases at respective frequencies over the overall wideband acoustic frequency range, and (c) combining the acoustic frequency components from the outputs of the sound transmission channels and transmitting a resultant of the combined acoustic frequency components to the ear of a hearing impaired individual, (d) the selectively modifying step being carried out such that the resultant of the combined acoustic frequency components has a substantially lower amplitude in one part of the overall wideband acoustic frequency range relative to other parts of said frequency range than the corresponding acoustic frequency components at the output of either of said sound transmission channels.

18. The method of claim 17, wherein the selectively modifying step selects the phase of the driving signal supplied to one of the sound sources in comparison to another such that acoustic frequency components in a low frequency range are out of phase at the outputs of the sound transmission channels.

19. The method of claim 17, wherein the selectively modifying step selects the phase of the driving signal supplied to one of the sound sources in comparison to another such that acoustic frequency components in a relatively high frequency range are out of phase at the outputs of the sound transmission channels.

20. The method of claim 17 wherein the sound sources are substantially identical.

21. A hearing aid with acoustic signal pickup means, amplification means, and sound reproduction means, said sound reproduction means comprising two sound sources, a common acoustic transmission channel, and sound transmission channels coupling the sound sources with said common acoustic transmission channel, said sound sources each being constructed for supplying acoustic frequency components covering a frequency range of sound to be supplied to the ear of the user, said sound reproduction means providing different sound transmission properties for the respective sound transmission channels such that a selected individually adapted differential transmission of the acoustic frequency components results via the respective sound transmission channels and such that relative amplitudes of the acoustic frequency components result at the common acoustic transmission channel representing a resultant frequency response specifically conformed to the individual hearing impairment of the user in spite of high gain operation of the amplification means, said sound transmission channels having respective different lengths such that the phase of sound transmission along one transmission channel changes by at least 180° compared to the phase of sound transmission along the other transmission channel within the frequency range of acoustic frequency components supplied by said sound sources, said sound sources supplying acoustic frequency components which are in phase, the different lengths of said sound transmission channels being such that low frequency components transmitted by the respective channels combine additively at the common acoustic transmission channel while higher frequency components of said frequency range are out of phase at said common acoustic transmission channel and tend to cancel each other.

22. A hearing aid with acoustic signal pickup means, amplification means, and sound reproduction means, said sound reproduction means comprising two sound sources, a common acoustic transmission channel, and sound transmission channels coupling the sound sources with said common acoustic transmission channel, said sound sources each being constructed for supplying acoustic frequency components covering a frequency range of sound to be supplied to the ear of the user, said sound reproduction means providing different sound transmission properties for the respective sound transmission channels such that a selected individually adapted differential transmission of the acoustic frequency components results via the respective sound transmission channels and such that relative amplitudes of the acoustic frequency components result at the common acoustic transmission channel representing a resultant frequency response specifically conformed to the individual hearing impairment of the user in spite of high gain operation of the amplification means, said sound transmission channels having respective different lengths such that the phase of sound transmission along one transmission channel changes by at least 180° compared to the phase of sound transmission along the other transmission channel within the frequency range of acoustic frequency components supplied by said sound sources, said sound sources supplying acoustic frequency components which are out of phase, the different lengths of said sound transmission channels being such that the lowest frequency components as transmitted by the respective channels tend to cancel each other at the common acoustic transmission channel while progressively higher frequency components of said frequency range are progressively more nearly in phase so as to be additive at the common acoustic transmission channel.

23. The method of adapting the frequency response of a hearing aid having plural sound sources each supplying acoustic frequency components covering an overall wideband acoustic frequency range during high gain operation, and having respective sound transmission channels each receiving the acoustic frequency components covering said overall wideband acoustic frequency range from a respective one of said sound sources, with the respective sound transmission channels having respective sound transmission properties which can be selected to adapt the frequency characteristic being supplied to the ear of a hearing impaired individual, said method comprising energizing the sound sources with a common range of acoustic frequencies so as to supply corresponding acoustic signals to the respective sound transmission channels, and selectively modifying the sound transmission properties of one of the sound transmission channels in comparison to another such that the acoustic frequency components after transmission by the respective sound transmission channels have respective different characteristics at respective frequencies over the frequency range to be supplied to the individual, and such that the acoustic frequency components have a combined effect at the ear of the hearing impaired individual which compensates for the specific hearing loss of the individual over said frequency range in spite of high gain operation of the hearing aid, wherein the sound sources are energized to supply corresponding acoustic signals which are out of the phase, the length of one of the sound transmission channels being selected relative to another such that low frequency components of the frequency range tend to cancel at the ear while higher frequency components of the frequency range tend to become additive at the ear of the hearing impaired individual so as to maintain a specific high frequency boost characteristic in spite of high gain operation of the hearing aid.

* * * * *